US006763120B2

(12) United States Patent
Sugiyama et al.

(10) Patent No.: US 6,763,120 B2
(45) Date of Patent: Jul. 13, 2004

(54) SPEAKER

(75) Inventors: Shigeru Sugiyama, Shizuoka (JP); Hajime Kitamura, Shizuoka (JP); Yoshio Imahori, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 140 days.

(21) Appl. No.: 10/100,988

(22) Filed: Mar. 20, 2002

(65) Prior Publication Data

US 2002/0150271 A1 Oct. 17, 2002

(30) Foreign Application Priority Data

Mar. 27, 2001 (JP) ..... P. 2001-089171

(51) Int. Cl.[7] ..... H04R 25/00
(52) U.S. Cl. ..... 381/395; 381/396; 381/398
(58) Field of Search ..... 381/361, 369, 381/170, 177, 386, 389, 393, 394, 395, 396, 398, 399

(56) References Cited

U.S. PATENT DOCUMENTS 1,711,514 A * 5/1929 Abrahams et al. ..... 381/395
5,757,942 A * 5/1998 Kamatani et al. ..... 381/396

* cited by examiner

*Primary Examiner*—Suhan Ni
(74) *Attorney, Agent, or Firm*—Sughrue Mion, PLLC

(57) ABSTRACT

A low cost dynamic speaker (10) prevents damage of the diaphragm (16) when the speaker (10) is mounted on a printed circuit board (2). An insulating ring (22) is attached to the front surface of the diaphragm (16) at the periphery. The insulating ring (22) has a pair of terminal pins (24) supported thereon for continuity of the lead wire (18*a*) with the conductor (4) of the printed circuit board (2). The conducting portion (24*b*) of each of the terminal pins (24) is protruded forward beyond the annular flat surface (22*a*) of the insulating ring (22).

4 Claims, 9 Drawing Sheets

50
52
52a
52b
54
54a
54b
54c
54c1
56
56a
56b
58
60
10
12
14
16
18a
22
22b
24
26
26a
26A
26B
2
2a
2b
2c
2d

SPEAKER

BACKGROUND OF THE INVENTION

1. Field of the Invention

The present invention relates to a speaker, particularly to a dynamic speaker to be mounted on a printed circuit board.

2. Description of the Related Art

A dynamic speaker is conventionally known among the types of a speaker. As shown in JP-A-6-178390, a dynamic speaker comprises a diaphragm having a voice coil attached on the back surface, and a magnetic circuit structure disposed on the back side of the diaphragm and adapted to support the diaphragm at the periphery thereof.

As shown in FIG. 9, an insulating ring 122 is attached to the front surface of a diaphragm 116 at the periphery thereof and thereby the diaphragm 116 is easily supported by a magnetic circuit frame 114. A pair of terminal members 124 are supported by the insulating ring 122, and thereby a pair of lead wires 118*a* drawn from a voice coil 118 are connected or fixed to the pair of terminal members 124.

Conventionally, a speaker 110 is first assembled in a holder 150 and then the holder 150 is fixed to a printed circuit board 102. The speaker 110 is housed in the holder 150 with the front side of the speaker 110 facing in the opposite direction to the printed circuit board 102. The holder 150, as shown in FIG. 9, comprises a holder body 152 and a cover 154. The speaker 110 is put tightly therebetween, and then the holder body 152 and the cover 154 are bonded.

Since the conventional speaker 110 is set in the holder 150 with the front side of the speaker 110 facing in the opposite direction to the printed circuit board 102, it has a disadvantage in that a lead wire fixing portion 124*a* and a conductive portion 124*b* (a portion connected to a conductor 104 of the printed circuit board 102 for continuity) of each of the terminal members 124 need be protruded backward with respect to the insulating ring 122.

This structure compels each of the terminal members 124 to be bent and formed in the shape of a letter "J". The terminal members 124 therefore need be long and complicated in design, causing an increase of the cost of the speaker 110.

Since the front side of the speaker faces in the opposite direction to the printed circuit board 102, it likely happens that the operator unintentionally touches the diaphragm 116 in mounting the speaker on the printed circuit board, causing a damage thereof.

SUMMARY OF THE INVENTION

An object of the present invention is to provide a low cost dynamic speaker which effectively prevents a damage of the diaphragm when the speaker is mounted on the printed circuit board.

The speaker of the present invention achieves the object by providing a terminal member of an improved structure.

According to an aspect of the present invention, there is provided a speaker to be mounted on a printed circuit board comprising:

a diaphragm;

a voice coil attached to the back surface of the diaphragm;

an insulating member attached to the front surface of the diaphragm at the periphery of the diaphragm; and a pair of terminal members supported by the insulating member, each of the pair of terminal members having a lead wire fixing portion for fixing an end of a lead wire drawn from the voice coil and a conducting portion for securing continuity of the lead wire with a conductor of the printed circuit board;

wherein the conducting portion of each of the terminal members is protruded forward beyond the front end of the insulating member.

The printed circuit board is not limited to the one as herein described. As far as it has a conductor connectable to the terminal members, any type of the printed circuit boards is applicable to the present invention.

The conductor may be formed either of the front side and the back side of the printed circuit board.

The diaphragm is not limited to the one as herein described. As far as it is adaptable as an element of a dynamic speaker, any type of the diaphragm is applicable to the present invention.

The voice coil is not limited to the one as herein described. As far as it is adaptable as an element of a dynamic speaker, any type of the voice coil is applicable to the present invention.

The insulating member is not limited to the one as herein described. As far as it is made of insulating material and adaptable to be attached to the front surface of the diaphragm at the periphery thereof, it may have the shape of a block, or alternatively it may be a ring extending along the periphery of the diaphragm.

According to the speaker of the present invention, the conducting portion of each of the terminal members is protruded forward beyond the front end of the insulating member. This structure has the following advantages.

Compared with the conventional terminal member having the shape of a letter of "J" for continuity with the conductor of the printed circuit board, the terminal member of the present invention is simply formed to be straight and short, thus contributing to reduction in cost of the speaker.

Further, when the speaker is mounted on the printed circuit board via the holder, the front side of the speaker faces the printed circuit board. This effectively prevents the operator from unintentionally touching the diaphragm during mounting operation, considerably reducing a risk of damage thereof.

Further, since the speaker is adapted to be directly in contact with the printed circuit board by a mounting structure of the present invention, the mounting height of the speaker on the printed circuit board is lowered than in the conventional structure.

The insulating member may have the shape of a ring extended along the periphery of the diaphragm, and the front end of the insulating member may comprise an annular flat surface.

Such insulating member enables the speaker to be closely attached to the printed circuit board at the entire periphery. In state where the speaker is mounted on the printed circuit board, the annular flat surface of the insulating ring abuts against the back surface of the printed circuit board so as to close a circular opening formed in the printed circuit board. The printed circuit board serves as a baffle plate, isolating the front space from the back space of the speaker and thus preventing a backward sound from traveling toward the front side of the speaker to interfere with a forward sound. This improves the sound characteristics of the speaker.

The pair of terminal members may be fixed to the insulating member by insert molding. This method firmly secures the terminal member to the insulating member, and also enables a simplified manufacturing process of the speaker.

Each of the terminal members may comprise a terminal pin penetrating the insulating member. This enables a simple structure and further reduces the cost of the speaker.

The conducting portion of each of the terminal members may be made of elastic material. This structure attains continuity across the terminal members and the printed circuit board without soldering operation and thereby facilitates the assembly of the speaker to the printed circuit board. The elastic terminal member comprises, for example, a plate spring and a coil spring.

DETAILED DESCRIPTION OF THE INVENTION

The present invention will be described below in detail with reference to the accompanying drawings.

Figure 1:
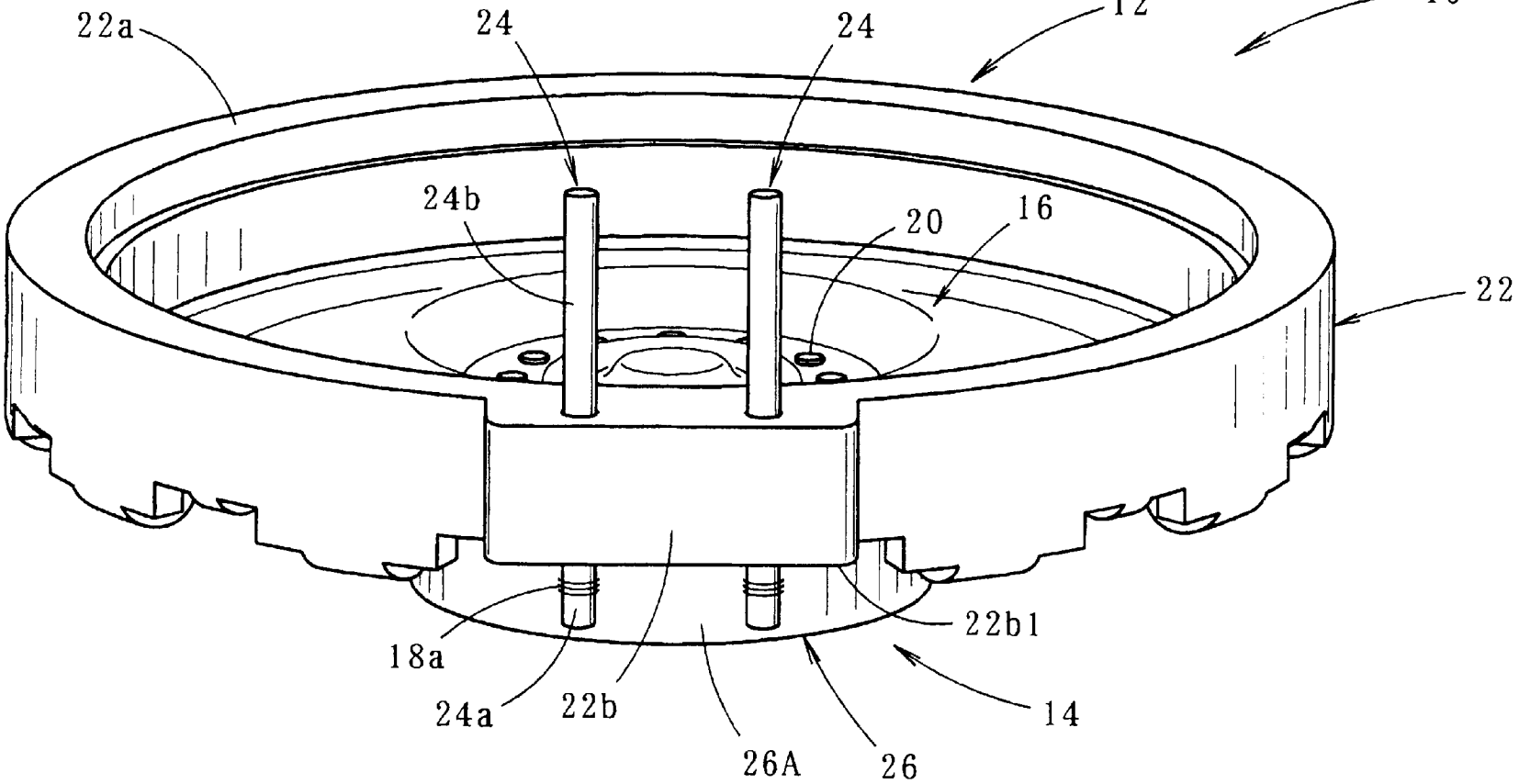
FIG. 1 is a perspective view of a speaker of the present invention.

FIG. 1 is a perspective view of a speaker 10 of the present invention with the front side facing upward as seen in the drawing.

Figure 2:
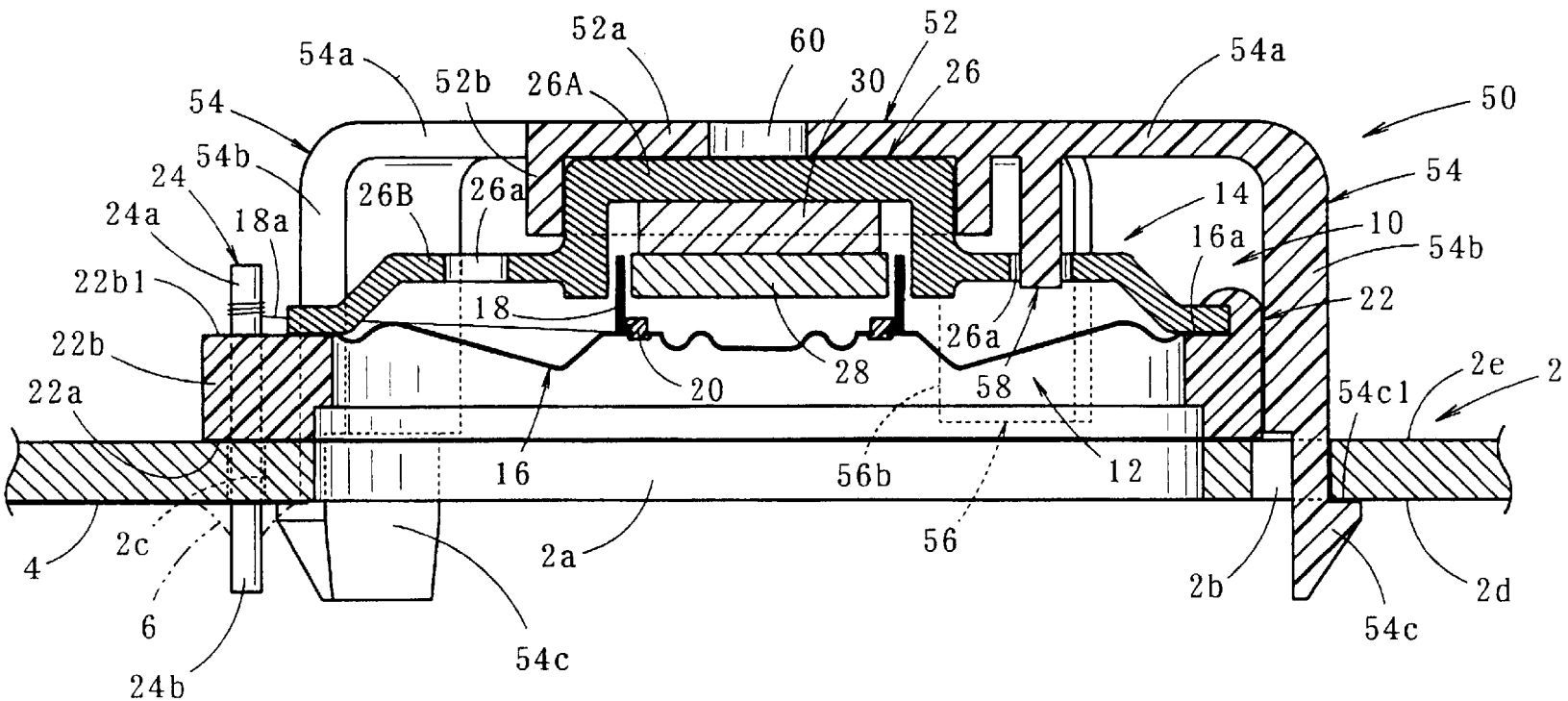
FIG. 2 is a side sectional view of the speaker mounted on a printed circuit board via a speaker holder.
Figure 3:
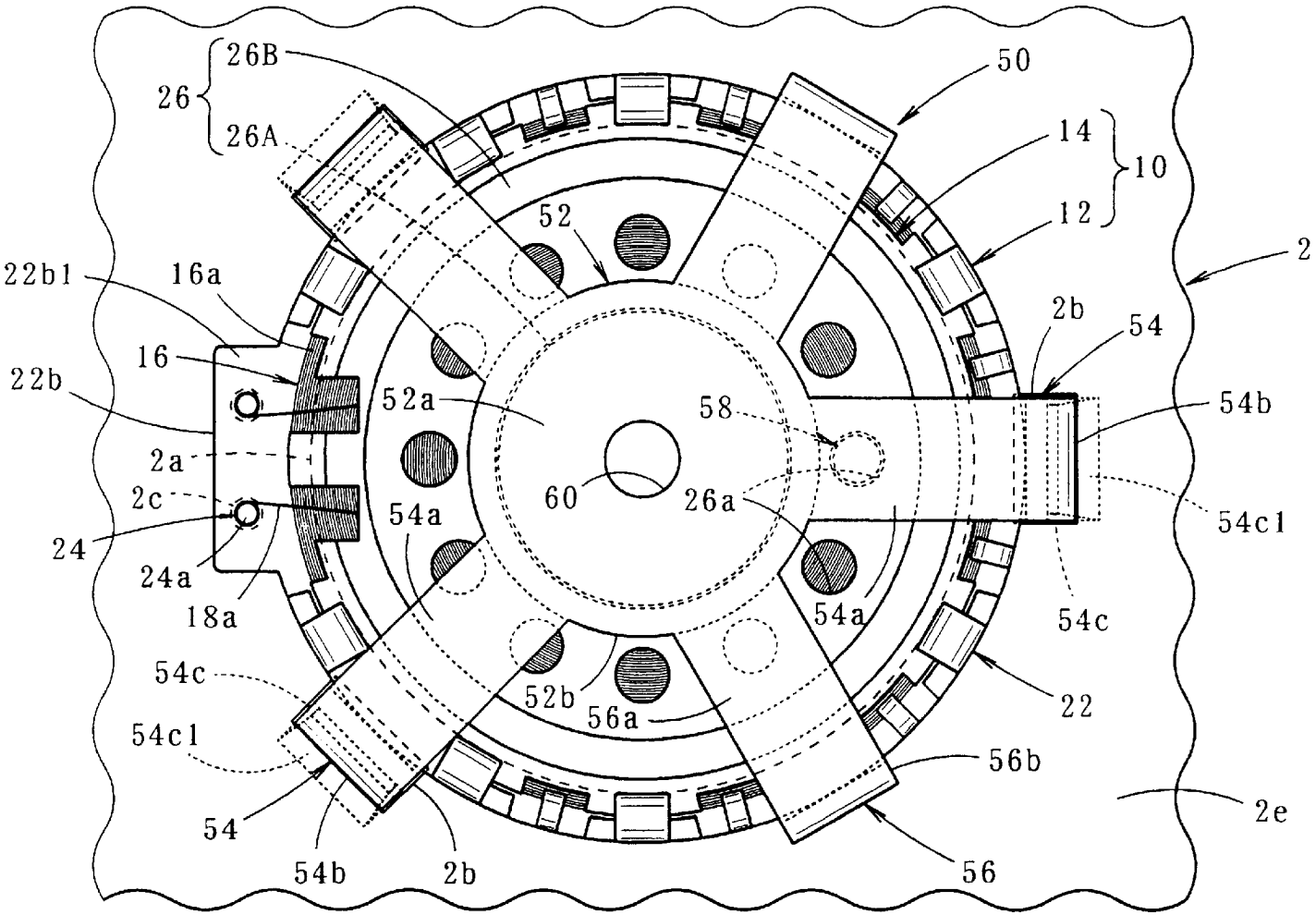
FIG. 3 is a top plan view of the speaker mounted on the printed circuit board via the speaker holder.

FIGS. 2 and 3 are a side sectional view and a top plan view respectively showing the speaker 10 mounted on a printed circuit board 2 with the front side of the speaker 10 facing downward as seen in the drawings.

As shown in these drawings, the speaker 10 is a small dynamic speaker (of an outer diameter of approx. 30 mm) which is mounted on the printed circuit board 2 together with other electronic components (not shown). The printed circuit board 2 is installed in, for example, a front instrument board in an automobile, and the speaker 10 is used as a sounding means for an alarm. The speaker 10 is fixed on the printed circuit board 2 via a speaker holder 50.

Figure 4:
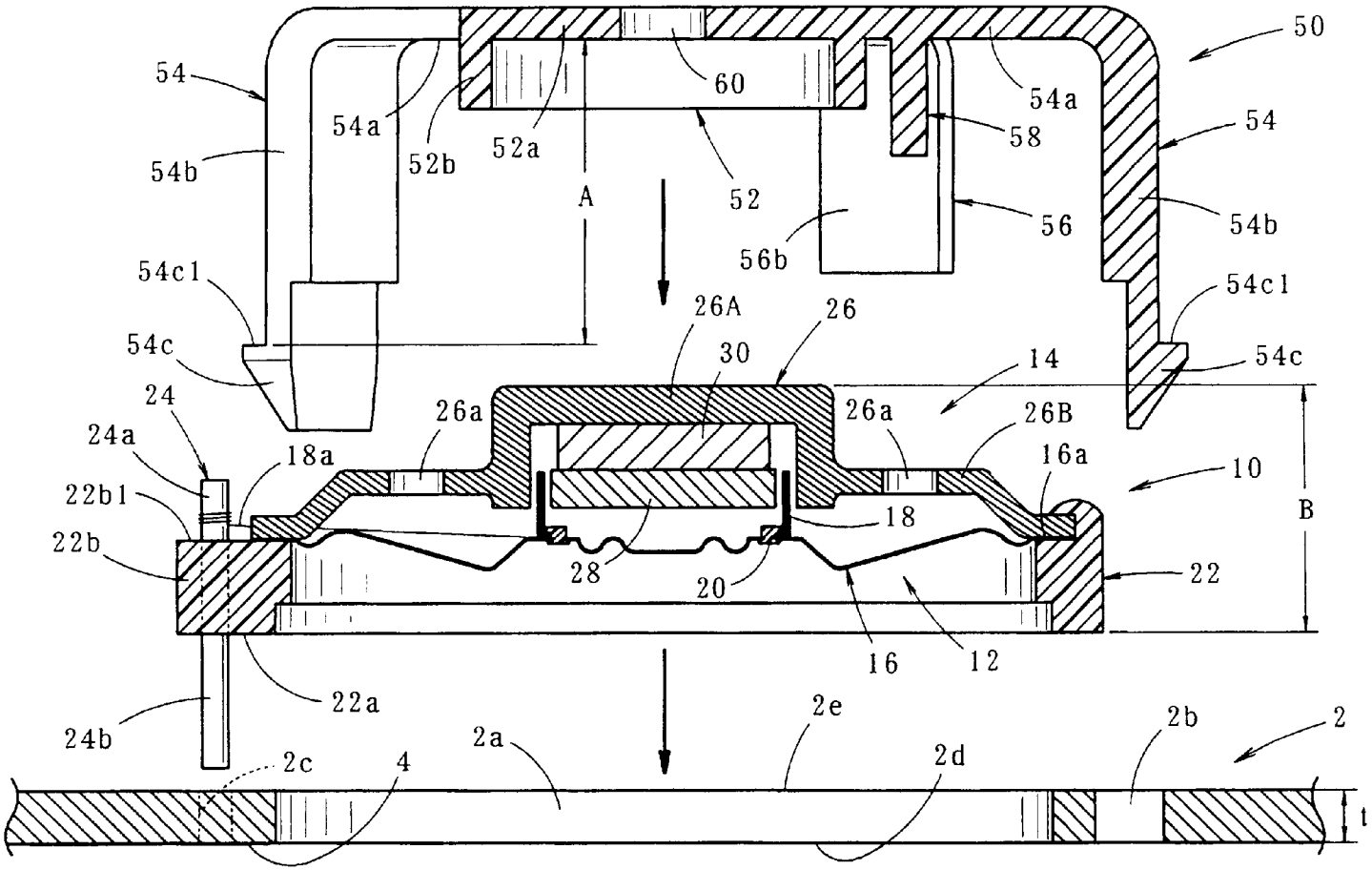
FIG. 4 is an exploded side sectional view of the speaker mounted on the printed circuit board via the speaker holder.
Figure 5:
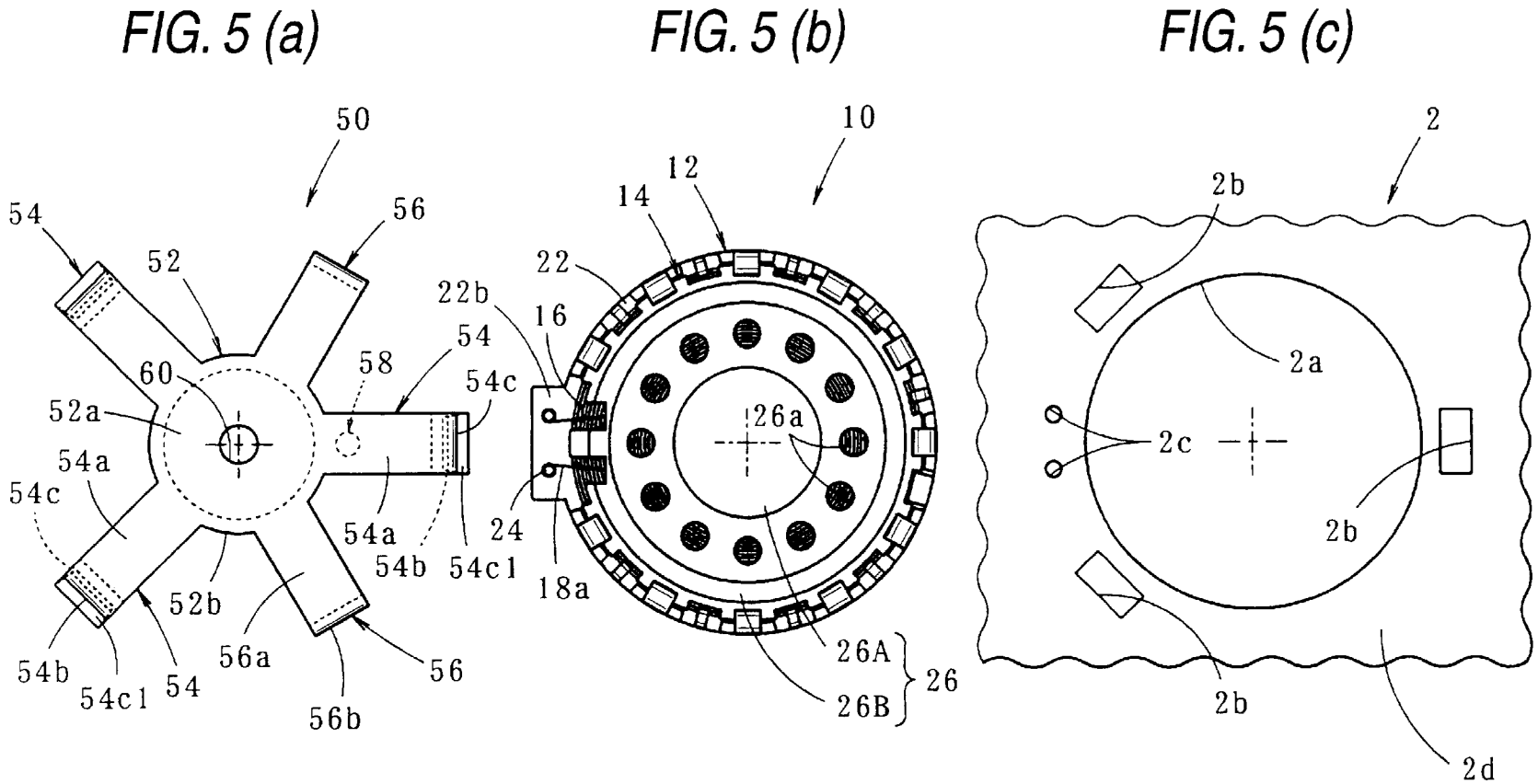
FIG. 5 is an exploded top plan view of the speaker mounted on the printed circuit board via the speaker holder.

FIGS. 4 and 5 are an exploded side sectional view and an exploded top plan view respectively showing the speaker 10 mounted on the printed circuit board 2 via the speaker holder 50.

As shown in these drawings, the speaker 10 comprises a diaphragm subassembly 12 and a magnetic circuit frame 14.

The diaphragm subassembly 12 comprises a diaphragm 16 having a circular periphery 16*a*, a voice coil 18 fixed on the back surface of the diaphragm 16 by a coil supporting member 20, an insulating ring 22 fixed on the front surface of the periphery 16*a* of the diaphragm 16, and a pair of terminal pins 24.

The insulating ring 22 is made of synthetic resin extending along the circumference of the diaphragm 16 and caulked thereto at a plurality of positions on the back end of the insulating ring 22. The front end of the insulating ring 22 is an annular flat surface 22*a*. An extended portion 22*b* of a predetermined width is formed on the periphery of the insulating ring 22 so as to radially extend outward. The pair of terminal pins 24 are supported by the extended portion 22*b* with a predetermined interval kept between the terminal pins.

The pair of terminal pins 24 are metal pins penetrating straight through the extended portion 22*b*, and fixed thereto by insert molding. A pair of lead wires 18*a* drawn from the voice coil 18 are wound on the pair of the terminal pins 24 respectively. The lead wires 18*a* are thereby connected to a conductor (conductor pattern) 4 of the printed circuit board 2 for continuity. Each of the terminal pins 24 comprises a lead wire fixing portion 24*a* and a conducting portion 24*b*. The lead wire fixing portion 24*a* projects backward from the back surface 22*b*1 of the extended portion 22*b*. The conducting portion 24*b* projects forward from the annular flat surface 22*a* of the insulating ring 22.

The magnetic circuit frame 14 comprises a frame 26 of rigid material, a magnet 30, and a yoke 28 of rigid material.

The frame 26 comprises a bottomed cylindrical portion 26A and an annular mounting portion 26B. The bottomed cylindrical portion 26A projects backward at the center of the speaker 10. The annular mounting portion 26B projects radially outward from the vicinity of the front end of the bottomed cylindrical portion 26A. The mounting portion 26B has an outer diameter substantially equal to that of the diaphragm 16. An annular flat portion is formed on the circumference of the mounting portion 26B. A plurality of sound emitting holes 26*a* are circumferentially provided on the mounting portion 26B at predetermined intervals to each other.

The magnet 30 and the yoke 28 are formed in the shape of a disk respectively. They are located in this order in the bottomed cylindrical portion 26A so as to be concentric to each other, and bonded to the frame 26. A cylindrical gap is formed between the outer surface of the yoke 28 and the inner surface of the bottomed cylindrical portion 26A having the same width over the entire circumference so as to accommodate a rear portion of the voice coil 18 in the gap.

The magnetic frame 14 is assembled with the diaphragm subassembly 12 by caulking the insulating ring 22 onto the frame 26. Specifically, the back end of the insulating ring 22 is caulked onto the front end of the annular flat portion of the mounting portion 26B of the frame 26 at a plurality of circumferential spots.

The structure of the speaker holder 50 will be explained below.

Figure 6:
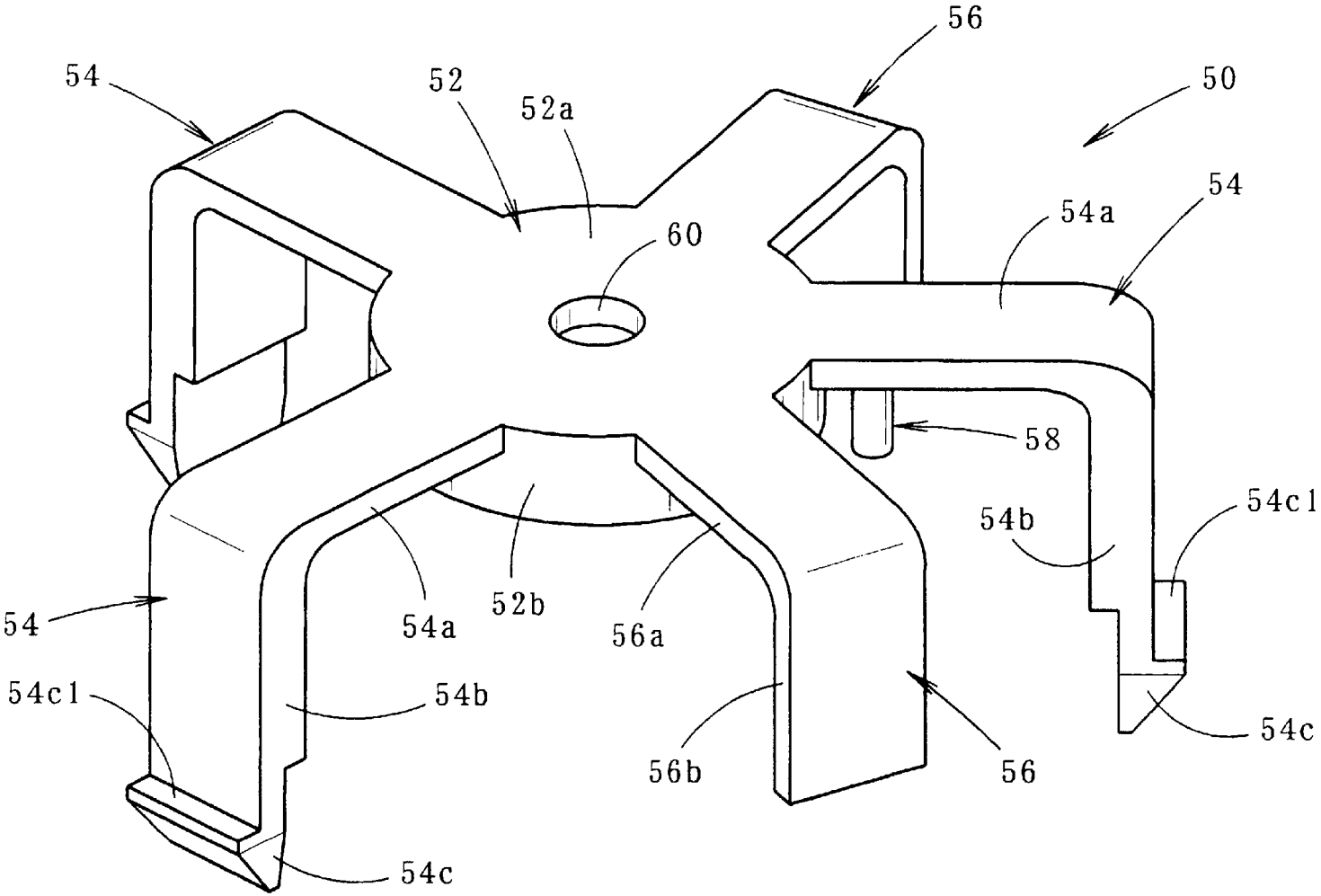
FIG. 6 is a perspective view of the speaker holder.

FIG. 6 is a perspective view of the speaker holder 50.

As shown in this drawing, the speaker holder 50 comprises a speaker engagement portion 52 at the center, three engagement legs 52 and two dummy legs 56 radially extending from the speaker engagement portion 52, and a positioning pin 58 formed on one of the engagement legs 52.

The speaker engagement portion 52 comprises a bottom portion 52*a* having an opening 60 at the center and a cylindrical portion 52*b* of a small height extending from the bottom portion 52*a*. The bottom portion 52*a* abuts the back surface of the bottomed cylindrical portion 26A of the frame 26 of the speaker 10. The speaker 10 is radially positioned by the cylindrical portion 52*b* which is adapted to be engaged with the cylindrical side surface of the bottomed cylindrical portion 26A.

Two of the engagement legs 54 are disposed at an angle of 135 degrees respectively with respect to the other of the engagement leg 54. The dummy legs 56 are disposed at an angle of 60 degrees respectively with respect to the other of the engagement leg 54.

Each of the engagement legs 54 has the shape of substantially a letter of "L". Each of the engagement legs 54 comprises a horizontal portion 54*a* radially extending outward from the bottom portion 52*a*, a vertical portion 54*b* vertically extending from the end of the horizontal portion 54*a* along the direction the cylindrical portion 52*b* extends, and a lance portion 54*c* formed at the end of the vertical portion 54*b*.

The vertical portion 54*b* is relatively thick compared with the horizontal portion 54*a* and a base part of the lance portion 54*c* at the end of the vertical portion 54*b*. Therefore, the rigidity of the vertical portion 54*b* is higher compared with that of the horizontal portion 54*a* or that of the base part of the lance portion 54*c*. Since the thickness is different between the vertical portion 54*b* and the base part of the lance portion 54*c*, there is formed a stepped portion at the inner surface of the end of the vertical portion 54*b*. The lance portion 54*c* has an engaging surface 54*c*1 at the side of the outer surface of the vertical portion 54*b*.

Each of the dummy legs 56 has also the shape of substantially a letter of "L". Each of the dummy legs 56 comprises a horizontal portion 56*a* radially extending from the bottom portion 52*a* and a vertical portion 56*b* extending from the end of the horizontal portion 56*a* along the direction the cylindrical portion 52*b* extends. The thickness of the vertical portion 56*b* is substantially equal to that of the horizontal portion 56*a*.

The positioning pin 58 is formed so as to protrude from the horizontal portion 54*a* of one of the engagement legs 54 along the direction the cylindrical portion 52*b* extends. The positioning pin 58 is disposed opposed to one of the sound emitting holes 26*a*, having an adequate length so that the front end of the positioning pin 58 is inserted into the sound emitting hole 26*a* when the bottom portion 52*a* of the holder 50 is brought to an engagement with the bottomed cylindrical portion 26A of the speaker 10.

As shown in FIG. 4, the dimension "A" between the inner surface (front surface) of the bottom portion 52*a* of the speaker engagement portion 52 and the engaging surface 54*c*1 of each of the lance portions 54*c* is set a smaller value than the sum of the dimension "B" and the dimension "t" where "B" is the dimension between the outer surface (back surface) of the bottomed cylindrical portion 26A and the annular flat surface 22*a* of the insulating ring 22, and "t" is the thickness of the printed circuit board 2.

The structure of the printed circuit board 2 will be described below.

As shown in FIG. 5(*c*), the printed circuit board 2 has a circular opening 2*a* of substantially equal diameter to the inner diameter of the insulating ring 22 so as to oppose the diaphragm 16 of the speaker 10. There are formed three rectangular engaging holes 2*b* and two circular pin holes 2*c* so as to surround the circular opening 2*a*. Each of the rectangular engaging holes 2*b* is opposed to each of the lance portions 54*c* of the holder 50, and each of the pin holes 2*c* is opposed to each of the terminal pins 24 of the speaker 10.

As shown in FIG. 4, the conductor 4 is extended to surround each of the pin holes 2*c* on the front surface 2*d* (the opposite surface to the speaker mounting surface) of the printed circuit board 2.

When the speaker 10 is mounted on the printed circuit board 2, the speaker 10 may be first mounted on the printed circuit board 2 and then the holder 50 may be fixed to the printed circuit board 2. Alternatively, the speaker 10 may be first set in the holder 50 and then the holder 50 retaining the speaker 10 therein may be fixed to the printed circuit board 2.

The latter method of operation will be described below.

The speaker 10 is set in the holder 50 by engagement of the speaker engagement portion 52 of the holder 50 with the bottomed cylindrical portion 26A of the frame 26 of the speaker 10. The holder 50 and the speaker 10 are circumferentially positioned by inserting the positioning pin 58 of the holder 50 into one of the sound emitting hole 26*a* of the speaker 10.

The holder 50 retaining the speaker 10 is then mounted on the printed circuit board 2 with the annular flat surface 22*a* of the insulating ring 22 abutting against the back surface 2*e* of the printed circuit board 2. This is achieved by inserting each of the terminal pins 24 of the speaker 10 into each of the pin holes 2*c* of the printed circuit board 2, and further by inserting each of the lance portions 54*c* of the holder 50 into each of the engaging holes 2*b* of the printed circuit board 2.

The above-mentioned insertion will be described. Each of the lance portion 54*c* firstly interferes with the outer edge of each of the rectangular engaging holes 2*b*. The base part of the lance portion 54*c* of relatively low rigidity is likely bent inward, and the horizontal portion 54*a* of the engagement leg 54 of relatively low rigidity is likely bent backward by a vertical reaction force that the lance portion 54*c* receives from the outer edge of the engaging hole 2*b*. The deflected horizontal portion 54*a* is pressed forward by an operator, thereby each of the lance portions 54*c* gets over the outer edge of each of the engaging holes 2*b* for engagement.

As above described, the dimension "A" of the holder 50 is set a slightly smaller value than the sum ("B"+"t") of the dimension "B" of the speaker 10 and the dimension "t" of the printed circuit board 2. This allows each of the horizontal portions 54*a* to be maintained in a deflected posture (slightly bent forward) in state where each of the lance portions 54*c* is engaged with each of the engaging holes 2*b*. The deflection of the horizontal portion 54*a* causes the speaker engagement portion 52 to constantly exert elastic pressure on the speaker 10. The speaker 10 is thereby pressed against the printed circuit board 2, assuring contact between the insulating ring 22 of the speaker 10 and the back surface 2*e* of the printed circuit board 2.

When the holder 50 retaining the speaker 10 is mounted on the printed circuit board 2, the two dummy legs 56 facilitate the operation. If there is no dummy leg, it would be difficult for the operator to allow the backward defection of the horizontal portion 54*a* and also to restore the position thereof since there is no hold for fingers other than the horizontal portion 54*a*. The dummy legs 56 provide a hold for fingers so as to facilitate the mounting operation.

After the speaker 10 is mounted and fixed on the printed circuit board 2 via the holder 50, each of the conducting portions 24*b* of the terminal pins 24 is soldered, as shown by the double-dash line in FIG. 2, thereby each of the terminal pins 24 is electrically connected with the conductor 4 of the printed circuit board 2.

As above described, according to the speaker 10 of the present invention, the conducting portion 24*b* of each of the terminal pins 24 is protruded forward beyond the annular flat surface 22*a* of the insulating ring 22. This structure has the following advantages.

Compared with the conventional terminal pin having the shape of a letter of "J" for continuity with the conductor 4 of the printed circuit board 2, the terminal pin 24 of the present invention is simply formed to be straight and short, thus contributing to reduction in cost of the speaker 10. Further, when the speaker 10 is mounted on the printed circuit board 2 via the holder, the front side of the speaker 10 faces the printed circuit board 2. This effectively prevents the operator from unintentionally touching the diaphragm 16 during mounting operation, reducing a risk of damage thereof. Further, since the speaker 10 is directly in contact with the printed circuit board 2, the mounting height of the speaker 10 on the printed circuit board is lowered than in the conventional structure.

Further, in state where the speaker 10 is mounted on the printed circuit board 2, the annular flat surface 22*a* of the insulating ring 22 abuts against the back surface 2*e* of the printed circuit board 2 so as to close the circular opening 2*a*. The printed circuit board 2 isolates the front space from the back space of the speaker 10, thereby serving as a baffle plate. This improves the sound characteristics of the speaker 10. The function as the baffle plate is further enhanced in the above described embodiment since the elastic pressure exerted from the holder 50 assures tight contact of the annular flat surface 22*a* with the back surface 2*e*.

Further, each of the terminal pins 24 is firmly secured to the insulating ring 22 by insert molding, and this method enables a simplified manufacturing process of the speaker 10.

A second embodiment of the invention will be described.

Figure 7:
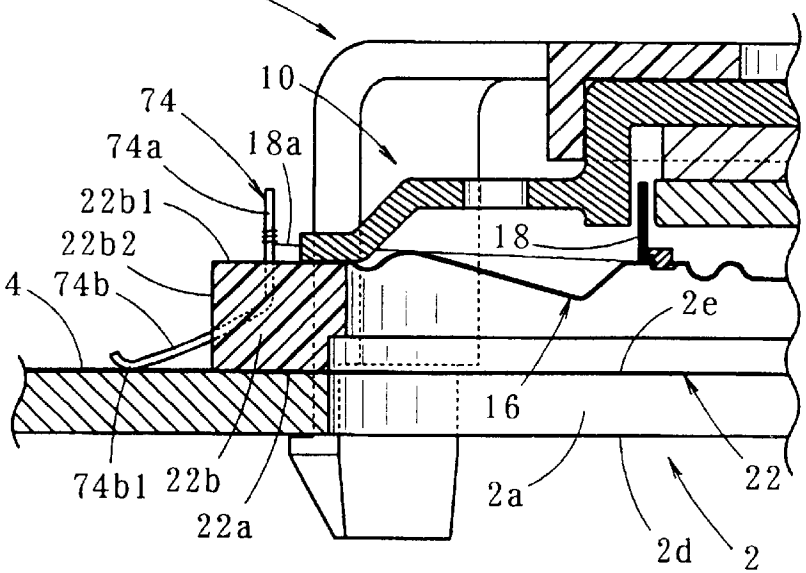
FIG. 7 is a partial side sectional view showing a second embodiment of the present invention.
Figure 7:
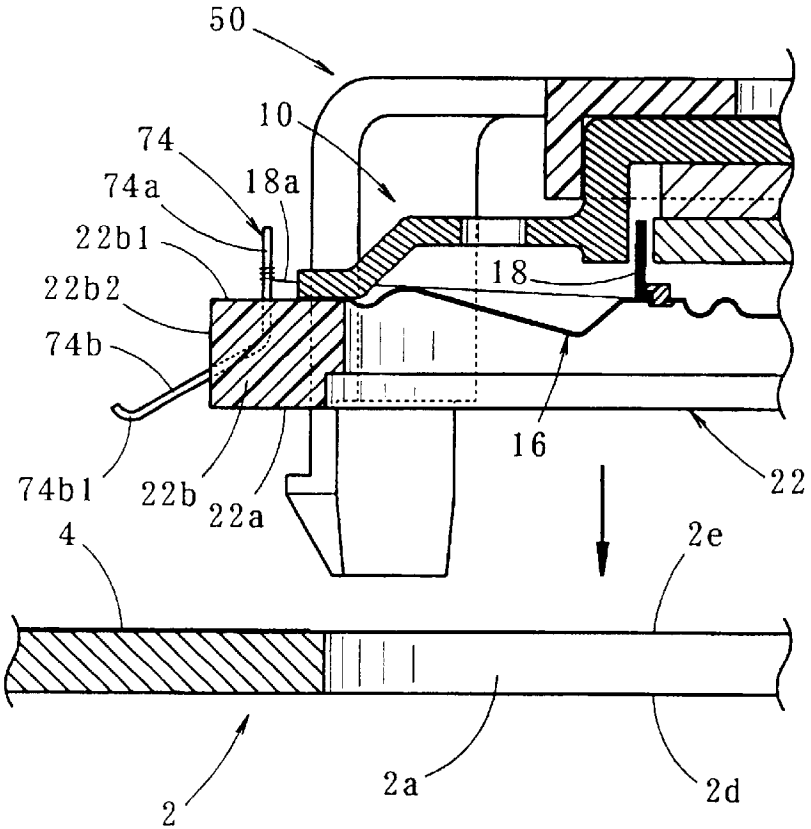

FIG. 7 is a partial sectional view of a second embodiment of the present invention.

As shown in FIG. 7(*a*), the speaker 10 of the second embodiment has a pair of terminal plates 74 instead of the terminal pins 24. The other elements of the speaker 10 are identical to those of the first embodiment.

Each of the terminal plates 74 is a bent plate spring, and secured to the insulating ring 22 by insert molding. A lead wire fixing portion 74*a* of each of the terminal plates 74 is straight protruded backward from the back surface 22*b*1 of the extended portion 22*b* of the insulating ring 22. A conducting portion 74*b* is an elastic piece which is protruded in an oblique downward direction from the outer circumferential surface 22*b*2 of the extended portion 22*b*. The conducting portion 74*b* is extended till a leading edge 74*b*1 thereof comes to a horizontal position beyond the annular flat surface 22*a* of the insulating ring 22. The leading edge 74*b*1 is curled upward.

The printed circuit board 2 of this embodiment has no pin holes 2*c* formed and has the conductor 4 formed on the back surface 2*e*.

As shown in FIG. 7(*b*), in state where the speaker 10 is mounted on the printed circuit board 2 via the holder 50, the leading edge 74*b*1 of the conducting portion 74*b* of the terminal plate 74 abuts against the back surface 2*e* of the printed circuit board 2, and thereby the conducting portion 74*b* is slightly deflected upward. This permits the leading edge 74*b*1 to be always elastically pressed against the back surface 2*e*, assuring an electrical connection between the conducting portion 74*b* and the conductor 4.

This structure enables a simplified structure of the printed circuit board 2 since it needs no holes for terminal pins. This structure also facilitates an assembly work when the speaker 10 is mounted on the printed circuit board 2 since an insertion (of terminal pins to holes) and a soldering (of the conductive portion 74*b* to the conductor 4) is not required.

Figure 8:
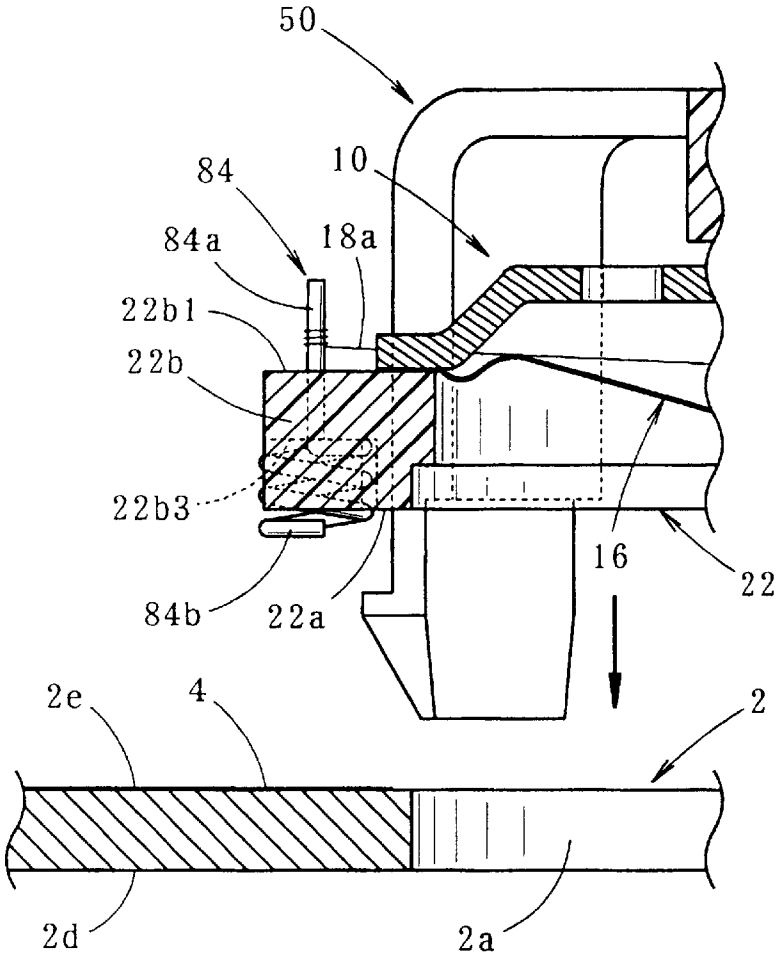
FIG. 8 is a partial side sectional view showing a third embodiment of the present invention.
Figure 8:
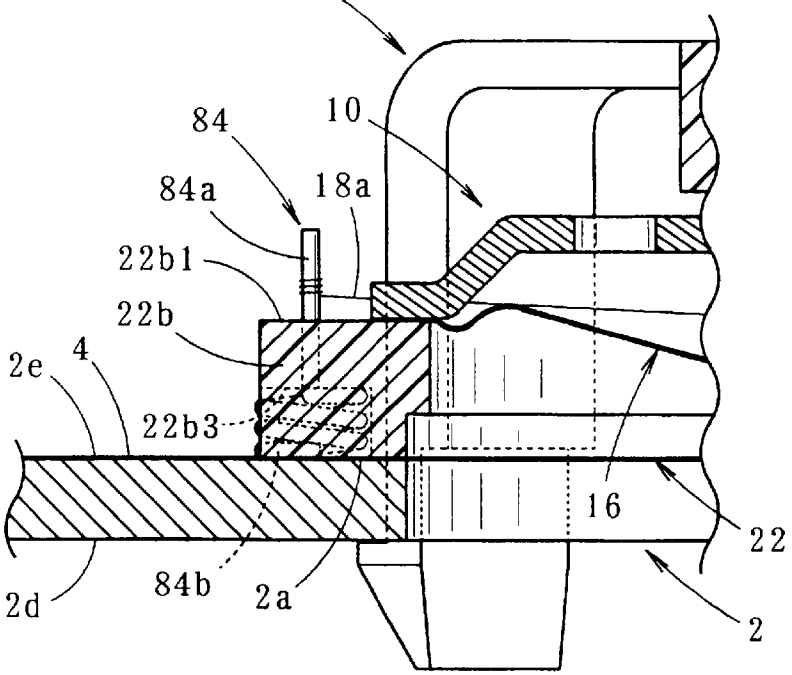
Figure 9:
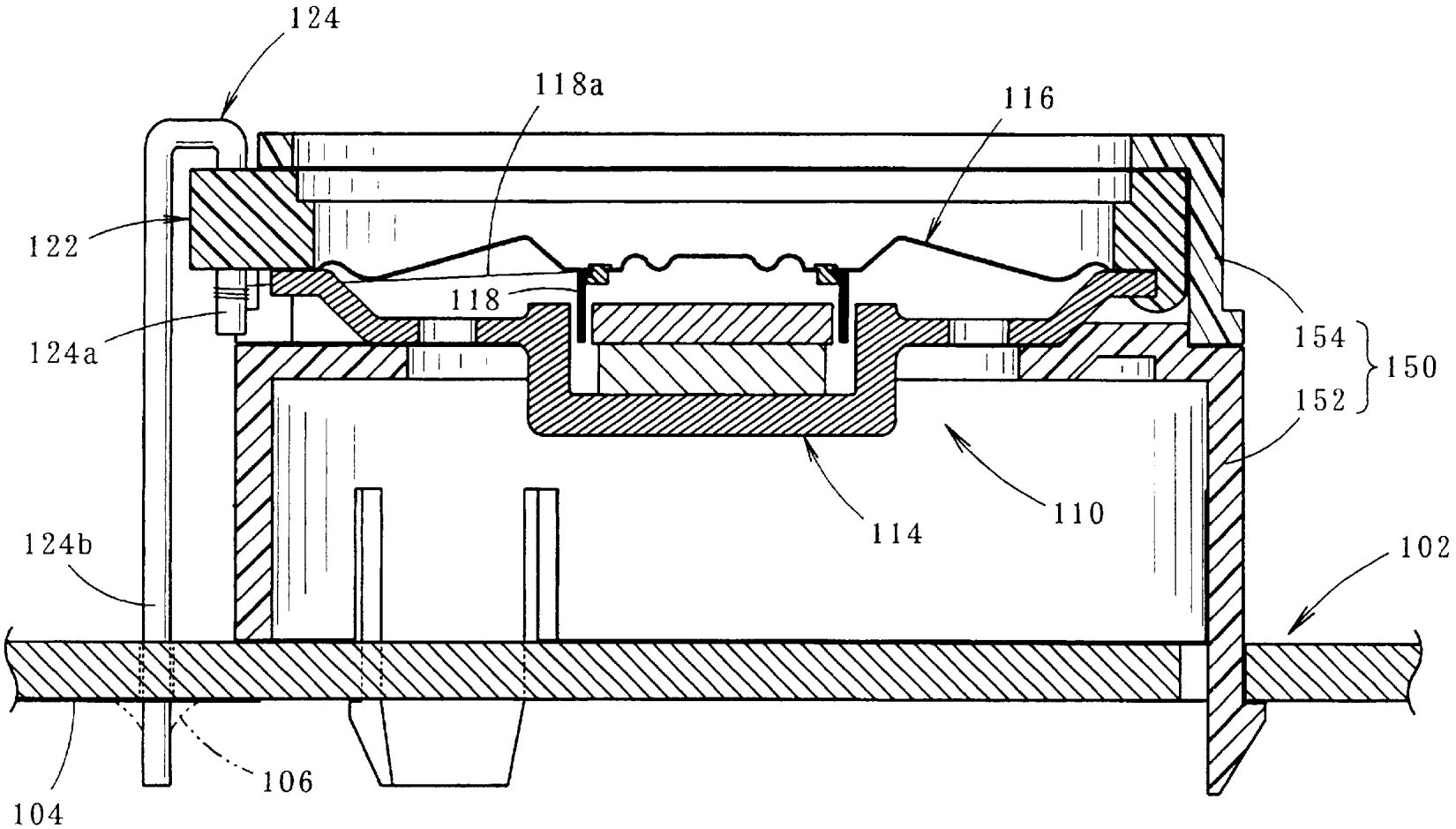
FIG. 9 is a side sectional view of a prior art.

FIG. 8 is a partial sectional view of a third embodiment.

As shown in FIG. 8(*a*), the speaker 10 of the third embodiment has a pair of coil spring terminal pins 84 instead of the straight terminal pins 24 in the first embodiment. The other elements of the speaker 10 are identical to those of the first embodiment.

Each of the terminal pins 84 is made of straight metal material with a part thereof coiled, and secured to the insulating ring 22 by insert molding. A lead wire fixing portion 84*a* of each of the terminal pins 84 is straight protruded backward from the back surface 22*b*1 of the extended portion 22*b* of the insulating ring 22. A conducting portion 84*b* is an elastic coil spring which is protruded into a recess 22*b*3 formed in the extended portion 22*b*. A leading edge of the conducting portion 84*b* is extended to a horizontal position beyond the annular flat surface 22*a* of the insulating ring 22.

The printed circuit board 2 of this embodiment has no pin holes 2*c* formed and has the conductor 4 formed on the back surface 2*e*.

As shown in FIG. 8(*b*), in state where the speaker 10 is mounted on the printed circuit board 2 via the holder 50, the leading edge of the conducting portion 84*b* of the terminal pins 84 abuts against the back surface 2*e* of the printed circuit board 2, and thereby the conducting portion 84*b* is compressed by pressure from the back surface 2*e*. This permits the conducting portion 84*b* to be always elastically pressed against the back surface 2*e*, assuring an electrical connection between the conducting portion 84*b* and the conductor 4.

This structure enables a simplified structure of the printed circuit board 2 since it needs no holes for terminal pins. This structure also facilitates an assembly work when the speaker 10 is mounted on the printed circuit board 2 since an insertion (of terminal pins to holes) and a soldering (of the conductive portion 84*b* to the conductor 4) is not required.

Though the above described embodiment shows a single straight metal material with a part thereof coiled, joining a straight pin and a coil spring into a piece is also applicable.

In the first to third embodiments, the terminal pins 24, the terminal plates 74 and terminal pins 84 are secured to the insulating ring 22 by insert molding. They may be, however, secured to it by other methods like press fitting.

What is claimed is:

1. A speaker to be mounted on a printed circuit board comprising:

a diaphragm;

a voice coil attached to the back surface of the diaphragm;

an insulating member attached to the front surface of the diaphragm at the periphery of the diaphragm; and a pair of terminal members supported by the insulating member, each of the pair of terminal members having a lead wire fixing portion for fixing an end of a lead wire drawn from the voice coil and a conducting portion for securing continuity of the lead wire with a conductor of the printed circuit board;

wherein the lead wire fixing portion is disposed on a back surface of the insulating member;

the insulating member includes a front end portion having a flat portion that abuts on the printed circuit board;

the conducting portion of each of the terminal members is protruded forward beyond the front end of the insulating member;

the pair of terminal members is fixed to the insulating member by insert molding; and the lead wire passes on the back surface of the diaphragm to be connected to the insulating member.

2. The speaker as claimed in claim 1, wherein the insulating member has the shape of a ring extended along the periphery of the diaphragm, and the front end of the insulating member comprises an annular flat surface.

3. The speaker as claimed in claim 1, wherein each of the terminal members comprises a terminal pin penetrating the insulating member.

4. The speaker as claimed in claim 1, wherein the conducting portion of each of the terminal members is made of elastic material.

* * * * *